United States Patent [19]

Henckel et al.

[11] 4,347,202

[45] Aug. 31, 1982

[54] METHOD FOR PRODUCTION OF DIRECTIONALLY ORIENTED LIGNOCELLULOSIC PRODUCTS, INCLUDING MEANS FOR CROSS-MACHINE ORIENTATION

[75] Inventors: David J. Henckel; Thomas E. Peters, both of Boise, Id.

[73] Assignee: Morrison-Knudsen Forest Products Co., Inc., Boise, Id.

[21] Appl. No.: 230,691

[22] Filed: Feb. 2, 1981

[51] Int. Cl.[3] ..... B06B 1/02

[52] U.S. Cl. ..... 264/24; 267/113

[58] Field of Search ..... 264/24, 113

[56] References Cited

U.S. PATENT DOCUMENTS

| | | | |
|---|---|---|---|
| 3,843,756 | 10/1974 | Talbott et al. | 264/24 |
| 4,111,294 | 9/1978 | Carpenter et al. | 264/24 |
| 4,113,812 | 9/1978 | Talbott et al. | 264/24 |
| 4,255,108 | 3/1981 | Bleymaier et al. | 264/24 |
| 4,284,595 | 8/1981 | Peters et al. | 264/24 |
| 4,287,140 | 9/1981 | Peters et al. | 264/24 |

*Primary Examiner*—James R. Hall

*Attorney, Agent, or Firm*—Seed, Berry, Vernon & Baynham

[57] ABSTRACT

Methods and systems are disclosed for (1) forming a mat of lignocellulosic particles electrostatically aligned in a cross-machine direction to the direction of movement of the mat being formed from the particles, and (2) forming a composite panel having a core layer of particles electrostatically aligned in the cross-machine dimension and face layers of particles electrostatically aligned in the machine direction. The multilayered or composite mat of electrostatically aligned particles employs separate orientation cells (30,32) for aligning the particles in the machine and cross-machine directions. For aligning the particles in the cross-machine direction, a uniformly distributed array of particles is passed through a high-voltage electrostatic orienting field having electrical lines of force extending substantially transverse to the direction of movement of the mat being formed. The orienting field may be formed between at least two uniformly spaced, electrically charged plates (60). The particles are deposited as a mat on a transfer belt (36) of a transfer conveyor (40) for transfer to a mat-receiving surface. The spaced, charged plates (60) are generally parallel to one another and oriented generally in the cross-machine direction of the mat being formed. The spaced, charged plates are preferably configured to spread the effects of particle migration and the shadow effect over the area of the orientation to minimize basis weight variation.

9 Claims, 11 Drawing Figures

METHOD FOR PRODUCTION OF DIRECTIONALLY ORIENTED LIGNOCELLULOSIC PRODUCTS, INCLUDING MEANS FOR CROSS-MACHINE ORIENTATION

TECHNICAL FIELD

This invention relates to a method for the formation of a mat of directionally oriented particles of lignocellulosic material such as wood fiber, flakes and strands aligned in a cross-machine direction and to a method for forming an oriented lignocellulosic panel.

BACKGROUND ART

Directional orientation of reconstituted lignocellulosic materials is known in the prior art as, for example, disclosed in U.S. Pat. Nos. 4,113,812 and 4,111,294. These patents discloses electrostatic orientation of lignocellulosic fibrous material in the direction of movement of a mat being formed on a moving horizontal support surface, or caul belt.

U.S. patent application Ser. No. 106,686, filed on Dec. 26, 1979, now U.S. Pat. No. 4,287,140, assigned to the same assignee as this application, discloses a continuous method and apparatus for forming an electrostatically oriented mat of discrete particles of lignocellulosic material making use of a transfer surface to transfer a mat of directionally aligned particles to a caul plate. An electrically non-conductive transfer surface is employed for formation of the mat thereupon, which mat is then transferred, with the particles oriented in the direction of movement of the mat being formed, onto a grounded, moving, electrically conductive, mat-receiving surface while still under the influence of an electrostatic field so that the particles do not lose their orientation. The structure disclosed includes multiple electrostatic plates aligned transversely to the direction of movement of the mats being formed. Particles free-fall through the electric field formed between the plates and are aligned along the direction of movement of the mat.

Formation of a mat having particles electrically aligned in the cross-machine or transverse direction to the direction of movement of the mat has not been satisfactorily carried out commercially.

DISCLOSURE OF THE INVENTION

It is an object of this invention to provide a method for electrostatically aligning lignocellulosic particles in a cross-machine direction to the direction of movement of the mat being formed.

It is another object of the invention to provide a method for electrostatically aligning lignocellulosic particles in the cross-machine direction such that the particles have a minimal basis weight variation over the area of the mat being formed.

It is another object of the invention to provide a method for electrostatically forming a reconstituted mat of lignocellulosic particles in multiple overlying layers, with the particles of each layer beng aligned in a different direction.

It is a further object of this invention to provide a method for electrostatically aligning lignocellulosic particles by forming a mat of aligned particles on a transfer conveyor having an electrically non-conductive transfer belt trained therearound, and transferring the aligned mat to a moving mat-receiving surface, the transfer conveyor including a nosepiece secured to the discharge end thereof having electrically conductive elements therein arranged to produce an electrical field transverse to the direction of movement of the transfer belt and mat-receiving surface to maintain the orientation of the particles during transfer from the transfer belt to the mat-receiving surface.

In accordance with these and other objects of the invention, a method for aligning lignocellulosic particles in the cross-machine direction includes providing a high-voltage, electrostatic orienting field having electrical lines of force extending substantially transverse to the direction of movement of the mat-receiving surface. A multitude of lignocellulosic particles are cascaded through the orienting zone for electrostatic alignment of their longer dimension generally parallel to the electrical lines of force within the orienting zone. The orienting field may be a series of uniformly spaced, charged electrode plates oriented generally in a direction parallel to the direction of movement of the mat and mat-receiving surface. The charged plates may have a plurality of offset planar portions which are parallel to the direction of movement of the mat or be of the configuration of a chevron or double-chevron, or other suitable shape for minimizing the average angle deviation from the desired cross-machine direction. The particles cascaded through the high-voltage electric field formed between the plates are deposited on an insulated transfer belt of a transfer conveyor beneath the orienting zone formed between the plates and are then transferred by the transfer belt onto a mat-receiving surface.

A method is also disclosed for forming a composite mat of lignocellulosic particles having a core layer aligned in the cross-machine direction and face layers covering both surfaces of the core layer aligned in the machine direction.

A nosepiece for the transfer conveyor is also disclosed, the nosepiece having electrically conductive elements embedded therein to produce an electrical field transverse to the direction of movement of the transfer belt to maintain the orientation of particles aligned in the cross-machine direction during their transfer from the transfer belt to the mat-receiving surface.

BEST MODE FOR CARRYING OUT THE INVENTION

The methods described herein are directed particularly to cross-machine orientation of discrete particles of lignocellulosic material, such as flakes, strands, chips, wafers, shavings, slivers, particles, etc. These particles are produced by knife-cutting or impact-disintegration of wood. Other lignocellulosic materials may also be used.

Figure 1:
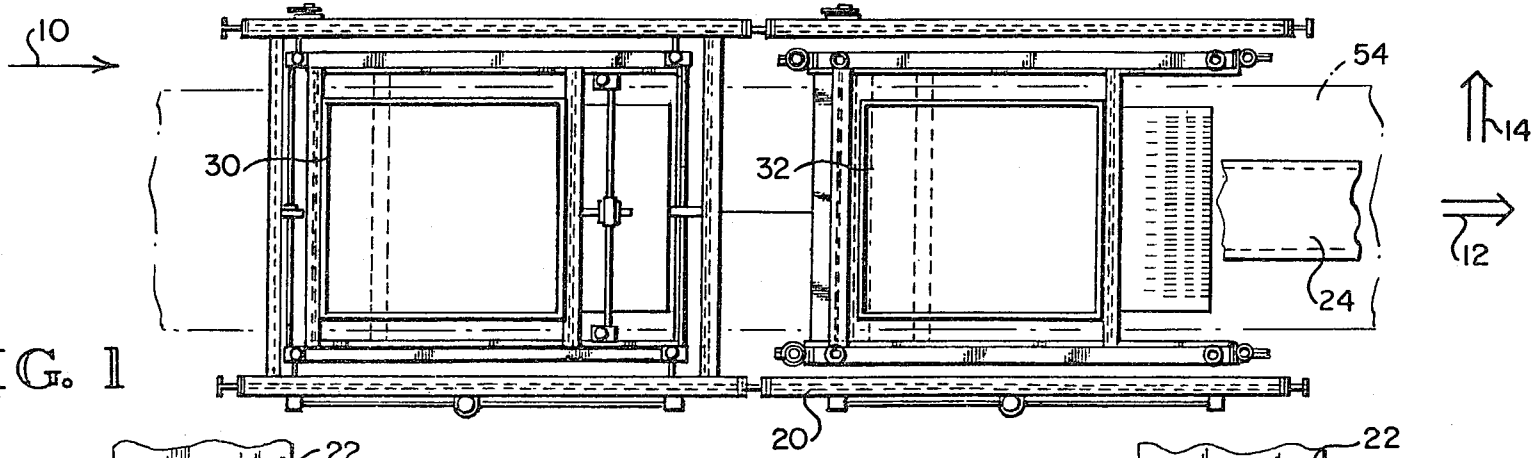
FIG. 1 is a partial plan view of apparatus for forming a multilayered mat of aligned particles having in-line and cross-machine particle orientation.
Figure 2:
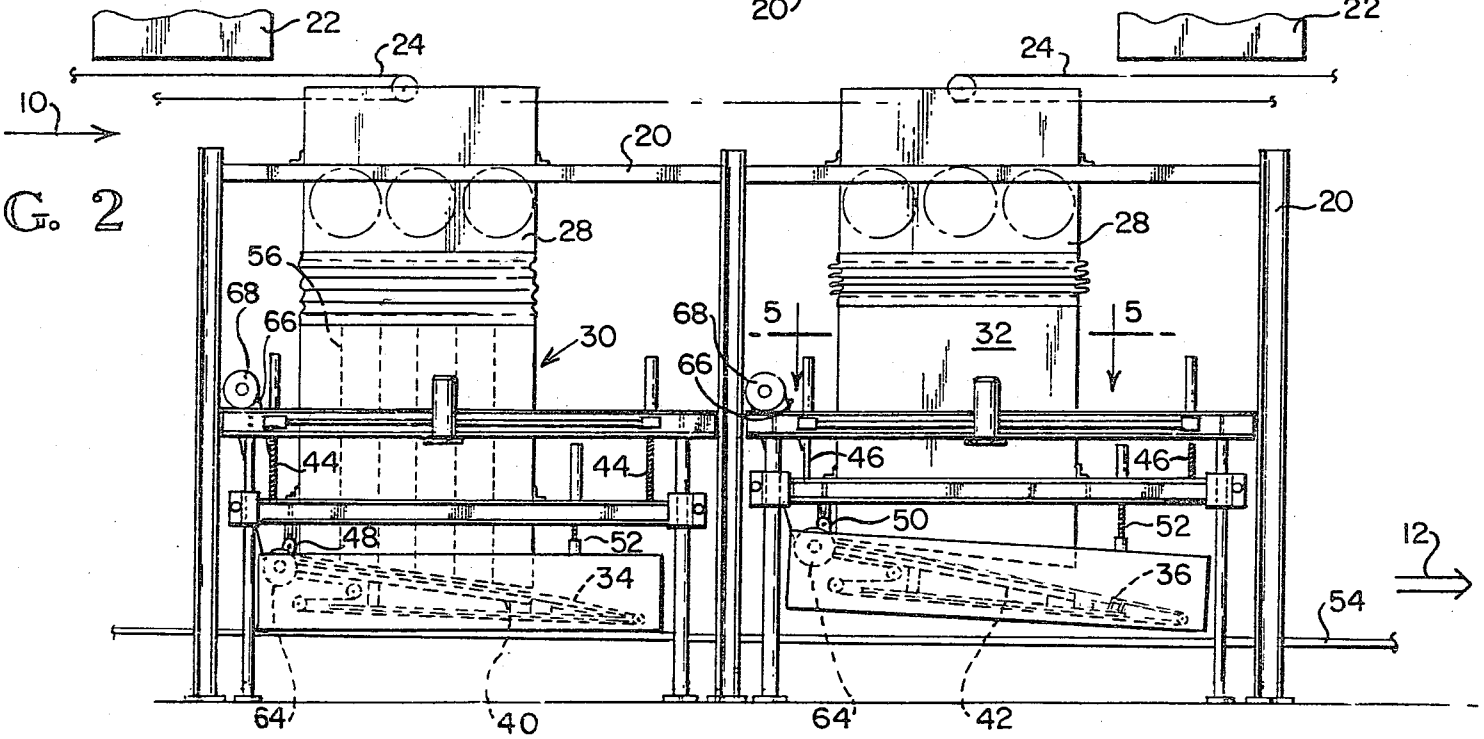
FIG. 2 is an elevation view of the apparatus of FIG. 1.

Referring to FIGS. 1 and 2, an installation 10 for forming of a composite, multilayered mat of electrostatically aligned, lignocellulosic particles is shown. Arrow 12 designates the in-line direction, that is, the direction in which the mat of oriented particles moves as it is being formed. Arrow 14 designates the cross-machine direction, that is, the direction extending perpendicularly or transverse to the in-line direction 12. Only two orientation cells are shown; however, aligned structural panels are generally formed of at least three layers; that is, a core layer oriented in the cross-machine direction and face layers over each surface of the core layers oriented in the machine direction of the panel being formed. Additional formers, machine and cross-machine orientation cells may be provided to produce five, seven, nine or more layers for pressing, if desired. Composite panels composed of veneer faces and an oriented flake-particle core may also be made.

The apparatus is mounted on a support frame structure 20, with the particles to be aligned and formed into mats stored in storage bins 22. The stored particles are metered onto conveyor belts 24. Particle distribution assemblies 28 evenly distribute the particles delivered by the belts 24 over the area inlets to an in-line orientation cell 30 and a cross-machine orientation cell 32. Each of the cells electrostatically orients the particles passing therethrough in the direction of the electric field provided within the respective cell. The oriented particles free-fall through the orientation cells 30, 32 and are deposited on respective transfer belts 34, 36 which run over inclined transfer conveyor decks 40, 42. The transfer decks 40, 42 are insulated so that the mats formed by the oriented particles retain their directional orientation. The transfer belt 34 transfers the mat of aligned particles formed thereon to an electrically conductive, mat-receiving surface or caul 54 which is preferably maintained at ground potential and supported on a continuous conveyor belt driven by suitable power means (not shown). The caul delivers the deposited material beneath the discharge end of transfer belt 36 where a second mat of particles aligned in the cross-machine direction is deposited over the first mat. Additional mats of particles aligned in the machine and cross-machine direction may be laid over the first and second layers, if desired. The resultant multilayered mat is then transferred to a press (not shown) where it is subjected to heat and pressure to form an aligned structural-use panel product composed of multiple layers, some oriented in the long dimension of the panel and some oriented in the short dimension.

Figure 3:
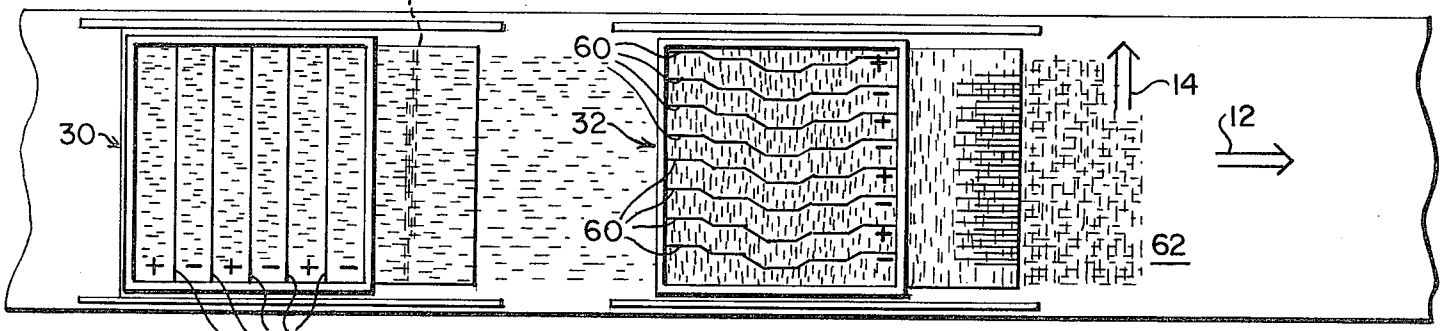
FIG. 3 is a plan schematic view of the orientation cells of FIG. 2.
Figure 4:
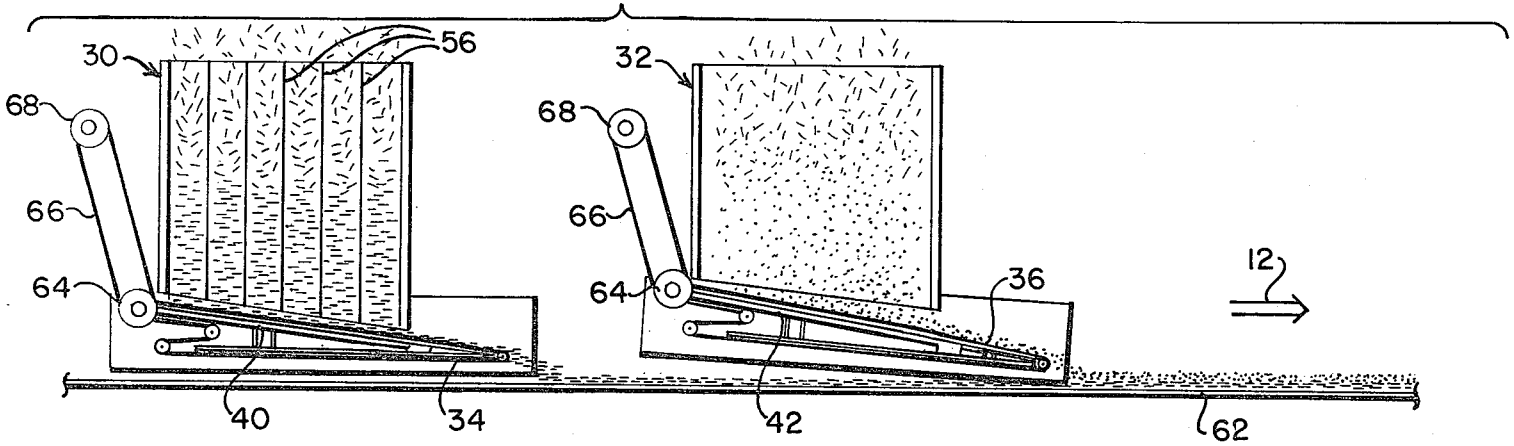
FIG. 4 is an elevation schematic view.

FIGS. 3 and 4 show in schematic form the function of the in-line orientation cell 30 and the cross-machine orientation cell 32. The in-line electrostatic orientation cell 30 includes a plurality of vertically aligned plates 56 extending in the cross-machine direction 14. Each of the vertical plates is charged with an appropriate potential such that an electric field is established between adjacent plates to electrostatically align the particles in the machine direction as they free-fall through the orientation cell. The magnitude of the voltage gradient between the spaced electrode plates, just above and along the transfer belt 34 positioned beneath the electrically charged plates, and between the transfer belt 34 and the mat-receiving surface or caul 54 may vary depending on numerous factors, such as the type, size, shape and moisture content of the material being used. Voltage gradients ranging between 1 kV/in and 12 kV/in may be used. Preferably, direct current is used, although alternating current may be used.

The cross-machine electrostatic orientation cell 32 includes a plurality of vertically aligned plates 60 which extend along the in-line direction 12. Particles freely falling through the cross-machine orientation cell 32 align themselves in the cross-machine direction 14, as indicated in FIGS. 3 and 4.

Figure 5:
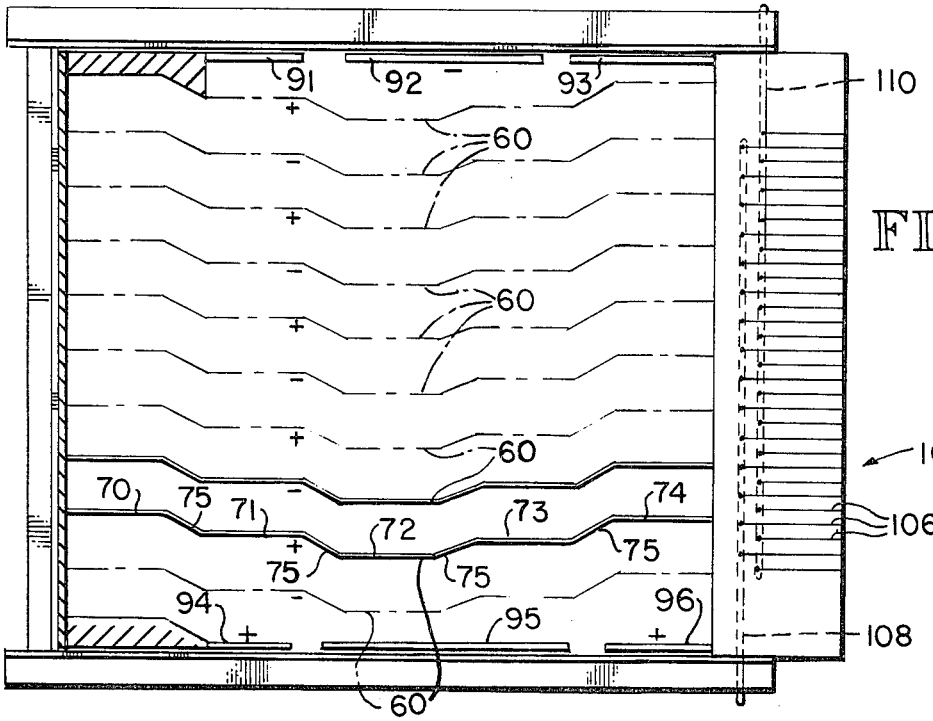
FIG. 5 is a sectional view taken along section line 5—5 of FIG. 1.

FIG. 5 shows one configuration of the cross-machine plates 60 which may be used. The plates 60 are each formed substantially alike and have a plurality of parallel planar sections 70, 71, 72, 73, 74 aligned in the in-line direction 12; that is, parallel to the direction of movement of the mat being formed. The planes of each of the planar sections 70, 71, 72, 73, 74 are each offset from the other in order to minimize the shadow effect of the particles being deposited on the mat passing beneath the lower ends of the plates. The offset displacement of each of the planar sections minimizes the basis weight distribution of material over the mat area such that no planar section aligns with any other planar section along the same parallel line extending in the direction of the in-line direction 12. The non-parallel portions 75 of the plates are obliquely positioned with respect to the in-line direction 12. The respective vertical end plate electrodes (see FIG. 5) are broken into sections 91, 92, 93 and 94, 95, 96, as illustrated. A lower degree of particle orientation is achieved in the cross-direction by the plate configuration shown, but the average deviation of particles over the mat surface substantially approaches the desired alignment and the basis weight variation over the area of the mat is minimized.

The transfer belts 34, 36 positioned below the respective orientation cells 30, 32 are coupled to sheaves 64, which are, in turn, driven through belt 66 from control motor 68.

The insulated inclined transfer conveyor deck 40 beneath the in-line electrostatic orientation cell 30 includes a plurality of conductive rods (not shown) embedded in slots formed in the surface of the plate 40, each of the rods aligned with the lower edges of each of the plates 60 and preferably maintained at the same potential and polarity as each corresponding plate, as described in copending application Ser. No. 106,686, now U.S. Pat. No. 4,287,140 the disclosure of which is incorporated herein by reference. It is also desirable to embed a conductive rod 58 (see FIG. 3) about half the distance between the last vertically charged plate at the discharge end of the orientation cell and the end of the transfer conveyor deck to aid in maintaining the strength of the electrical field and alignment of the particles making up the mat on the transfer belt 34.

Figure 6:
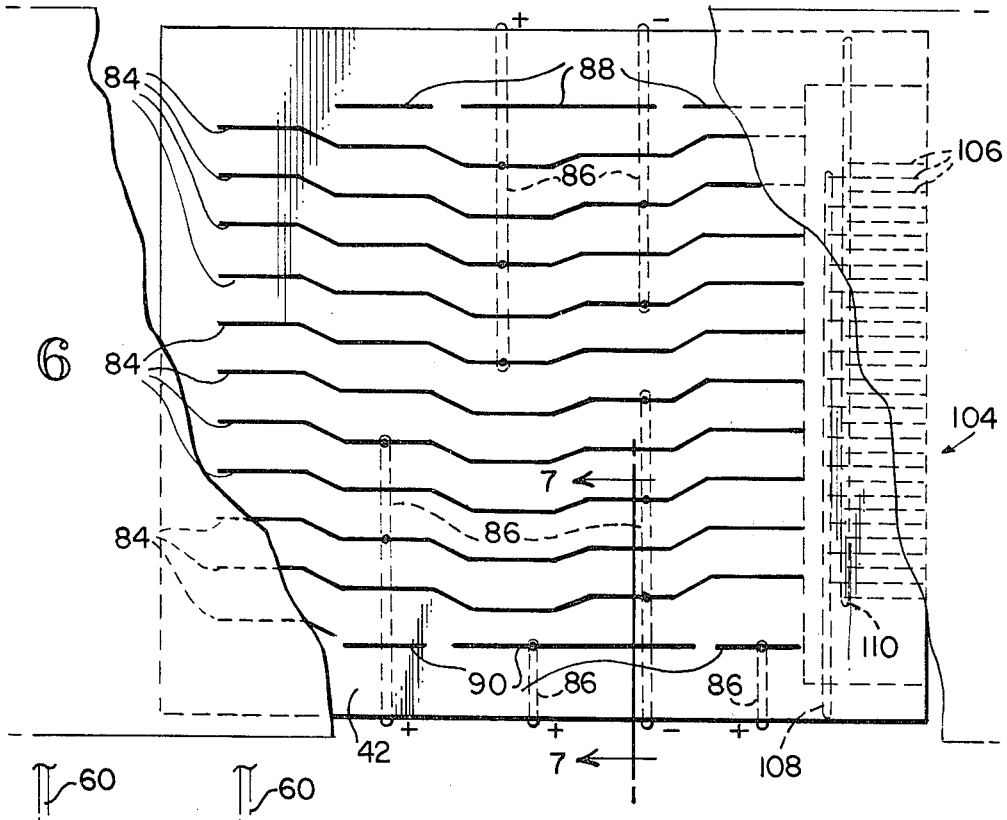
FIG. 6 is a plan view of the deck of the transfer conveyor used beneath the cross-machine orientation plates.
Figure 7:
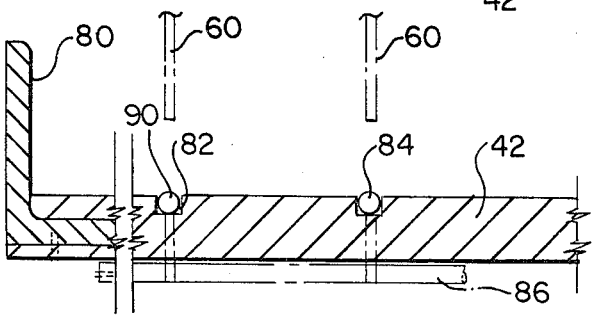
FIG. 7 is a sectional view taken along line 7—7 of FIG. 6.
Figure 10:
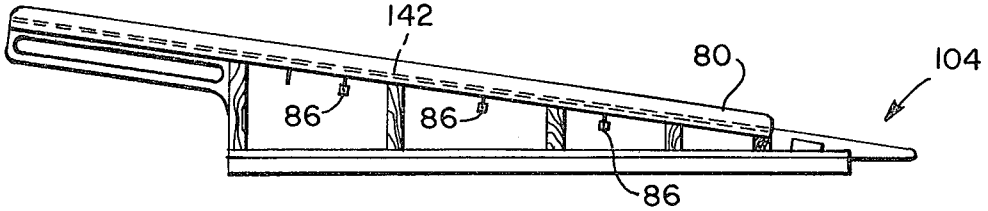
FIG. 10 is a vertical cross-section of the cross-machine transfer conveyor deck of FIG. 6 showing the nosepiece mounted on the discharge end of the conveyor deck.

FIGS. 6, 7, and 10 illustrate plan and cross-sectional views of the insulated inclined transfer conveyor deck 42 for the cross-machine electrostatic orientation cell 32. The transfer deck 42 if formed of an electrically insulating material, such as glass fiber-reinforced resin, and has parallel side flange portions 80 on each side thereof. Along the inner surface of the deck 42 are a series of channels or slots 82 in which electrically conductive rods 84 are embedded, the rods having the same offset configuration as the offset, vertically spaced plates 60 located directly above the conveyor deck. The rods 88 and 90 at each end of the deck have the same configuration as plates 91–96.

Figure 8:
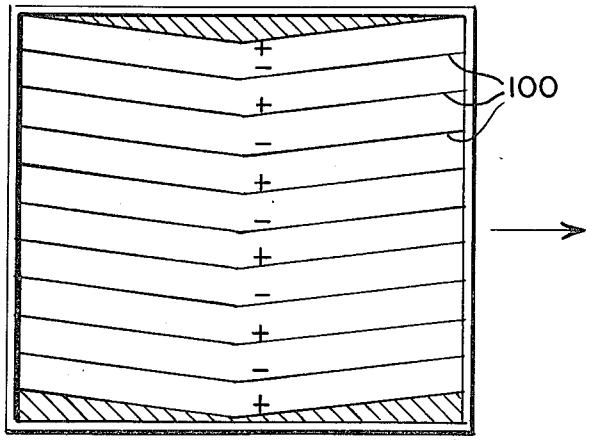
FIGS. 8 and 9 are plan views of alternative electrode configurations embedded in a conveyor deck for cross-machine orientation, the conveyor deck not including the nosepiece.

The conductive rods 84, 88 and 90 embedded in the slots are electrically connected to one another and to a source of electrical potential by suitable connector bars 86 extending beneath the conveyor deck 42 at right angles to the length dimension of the rods 84, 88 and 90. A nosepiece 104, to be described more fully later, is secured to the discharge end of the conveyor deck as illustrated in FIG. 8.

Referring to FIG. 2, the transfer conveyor decks 40 and 42 are pivotally mounted at points 48 and 50 just above the axis of sheave 64 beneath the respective orientation cells 30 and 32. The distance between the transfer conveyors 40 and 42 and mat conveyor 54 may be adjusted by adjustment of jackscrew sets 44 and 46 to adjust the thickness of the mat on the caul. The degree of inclination of the respective transfer conveyor decks relative to the caul 54 is adjusted with jackscrews 52 to change the distance between the electrode plates and transfer conveyor decks at the discharge end.

Figure 9:
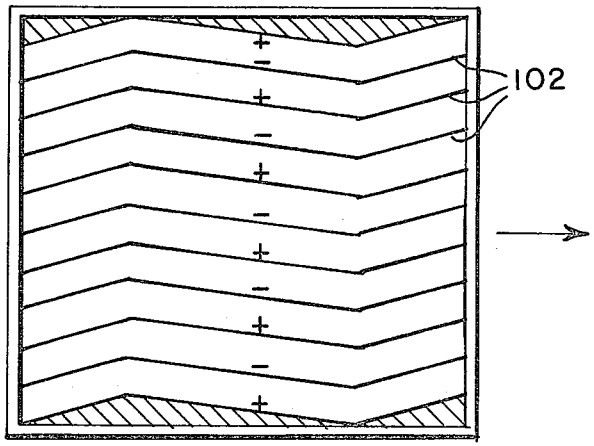

Rather than the configuration of the plate electrodes of the orientation cell shown in FIG. 5, other electrode patterns may be used (see FIGS. 8 and 9) wherein the electrodes are offset from the cross-machine direction to spread the effect of electrode location over the area of orientation to minimize basis weight variation. The configuration of the electrodes should be such as to minimize the average angle deviation from the desired perpendicular direction to the machine direction. In FIG. 8, the vertically spaced electrode plates 100 have a generally chevron configuration. In FIG. 9, the spaced electrode plates 102 have a double chevron configuration. Other configurations may also be used. The configuration of the electrodes embedded in the transfer conveyor deck should conform to that of the vertically spaced electrodes.

Figure 11:
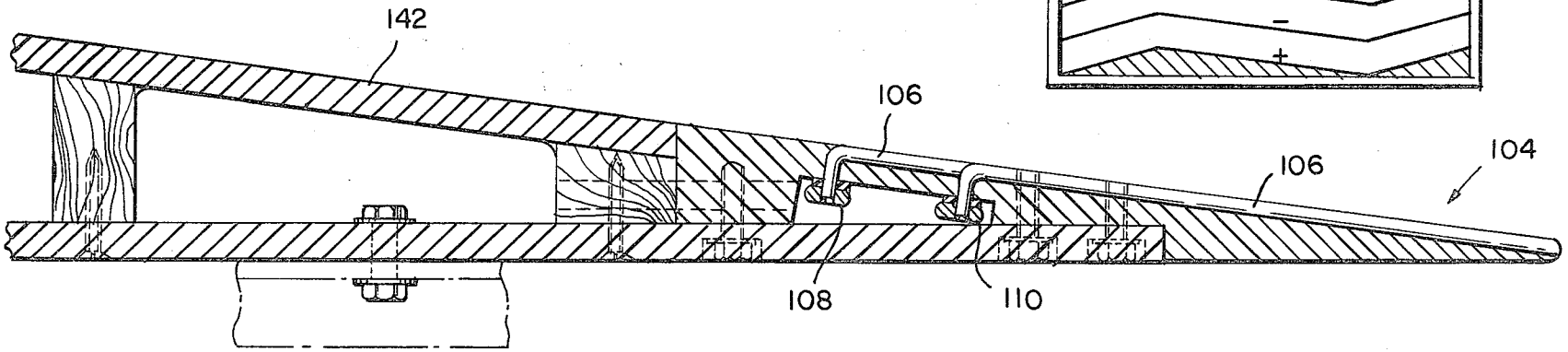
FIG. 11 is an expanded vertical cross-section view of the nosepiece of the cross-machine transfer conveyor of FIG. 5.

FIG. 11 illustrates a cross-section of the nosepiece 104 of the conveyor deck for the cross-orientation cell which is fabricated from a piece of a substantially electrically non-conductive material having a series of parallel slots or grooves formed in the upper surface thereof at spaced intervals. These grooves receive rod electrodes 106, as illustrated in FIG. 11, each of the rod electrodes connected to respective connector bars 108 and 110. The connector bars are electrically connected to a source of electrical potential to deliver electrical charges of different potential to adjacent electrodes in a similar manner as electrical power is delivered to the rods embedded in the conveyor deck. The conductive elements embedded in the nosepiece extend parallel to the direction of movement of the transfer belt and are alternately charged positive and negative, with the electrical potentials running from 1 kV/in to 12 kV/in. The function of the nosepiece is to produce an electrical field immediately around the nosepiece which is perpendicular or transverse to the direction of movement of the transfer belt so that as the lignocellulosic particles are transferred from the transfer belt to the caul belt, they remain under the influence of the electrostatic field and remain oriented, particularly those particles on the lower surface of the mat formed on the transfer belt.

To electrostatically align particles in the cross-machine direction, the particles are uniformly distributed over the inlet area of the cross-machine orientation cell 32 utilizing a particle distributor 28. A high-voltage, electrostatic orienting field is established between the adjacent plates 60 of the orientation cell 32, with the plates 60 being uniformly spaced at points positioned essentially transverse to the in-line direction 12. The plates 60 have portions 70, 71, 72, 73, 74 which are parallel to the in-line direction. The high-voltage field between the pairs of plates electrostatically orients the particles cascading therebetween so that the particles are aligned parallel to the field and deposited as aligned on the transfer belt 36. The mat formed on the transfer belt is then moved to transfer the formed mat to the caul 54.

It is desirable to run the transfer conveyor belt 36 of the cross-orientation cell 32 at a higher speed than the caul 54 in order to crowd the particles making up the mat as they are being transferred from the transfer belt to the caul. The crowding helps reduce particle misalignment during transfer. The transfer belt 36 is generally run 1–10% faster than the caul 54. It is also desirable to run the transfer conveyor belt 34 of the in-line orientation cell 30 at a slower speed than the caul 54 to pull the particles in alignment as they are being transferred from the transfer belt 34 to the caul.

While particular embodiments of the invention have been shown and described, it should be understood that the invention is not limited thereto since many modifications may be made. It is therefore contemplated to cover by the present application any and all such modifications that fall within the true spirit and scope of the underlying claims.

We claim:

1. A method of forming a continuous mat of directionally oriented lignocellulosic particles and depositing the mat on a mat-receiving surface in a direction substantially transverse to the direction of movement of the mat-receiving surface, comprising:

providing a high-voltage orienting zone generating a directional electrical field substantially transverse to the direction of movement of the mat-receiving surface for alignment of particles generally transverse to the direction of movement thereof, cascading a multitude of lignocellulosic particles through the orienting zone for electrostatic alignment thereof with their longer dimension generally parallel to the electrical lines of force within the orienting zone, moving a mat-receiving surface below the orienting zone to receive the cascading aligned particles thereon to form a continuous mat, and causing an electrical current to flow within the mat on the mat-receiving surface to produce a directional electrical field immediately above the mat substantially transverse to the direction of movement of the mat-receiving surface and parallel to the electrical field of the orienting zone.

2. A method of forming a continuous mat of directionally oriented lignocellulosic particles and depositing them on a moving mat-receiving surface with the particles oriented in a direction substantially transverse to the direction of movement of the mat-receiving surface, comprising:

providing a high-voltage orienting zone generating a first directional electric field of sufficient field strength to align the particles of lignocellulosic material, cascading a multitude of particles of lignocellulosic material through the orienting zone for alignment thereof generally parallel to the electrical lines of force within the orienting zone, providing an electrically insulated transfer surface beneath the orienting zone for receiving the multitude of particles descending through the orienting zone thereon, the particles forming a mat of aligned particles on the transfer surface, moving a mat-receiving surface adjacent the discharge end of the transfer surface to receive the mat of aligned particles thereon, the mat-receiving surface being electrically isolated from the high-voltage orienting zone, and transferring the mat formed on the transfer surface by movement thereof to the mat-receiving surface under the continuous influence of a second directional electrical field established immediately above the transfer surface and parallel to the first directional field.

3. The method of claim 2 wherein the first directional electrical field is established by providing a plurality of vertically extending, spaced-apart, electrically conductive plates in parallel alignment with each other and extending substantially parallel to the direction of movement of the mat-receiving surface, but at a slight angle thereto in order to minimize the effect of the weight distribution of particles over the mat area.

4. The method of claim 2 wherein the particles are cascaded through the first directional electric field formed between at least two vertically extending plates which are uniformly spaced from each other transverse to the direction of movement of the mat-receiving surface, the plates having a plurality of portions which are aligned parallel to the direction of movement of the mat-receiving surface but offset from each other to distribute the effect of particle distribution over the area of the mat.

5. The method of claim 4 wherein the plates have a general chevron shape along their length dimension.

6. The method of claim 4 wherein the plates have a general double-chevron shape along their length dimension.

7. The method of claim 2 wherein, during transfer of the mat from the transfer surface to the mat-receiving surface, the particles are subjected to a discharge orienting field at the discharge end of the transfer surface, the discharge orienting field extending transverse to the direction of movement of the transfer surface to maintain the orientation of the particles making up the mat during transfer to the mat-receiving surface.

8. The method of claim 2 wherein the mat-receiving surface is moved at a linear velocity less than the linear velocity of the transfer surface for transfer of the mat of aligned particles from the transfer surface to the mat-receiving surface.

9. The method of claim 1, including forming a multi-layered mat of directionally aligned particles by forming a mat of particles on the mat-receiving surface aligned in the direction of movement of the mat-receiving surface prior to deposition of particles aligned substantially transverse to the direction of movement of the mat-receiving surface.

* * * * *